US005810232A

United States Patent [19]

Meurer et al.

[11] Patent Number: 5,810,232

[45] Date of Patent: Sep. 22, 1998

[54] TOOL SUPPORT

[76] Inventors: John Meurer, P.O. Box 12625, Lake Park, Fla. 33403; Michael J. Hayden, 1767 Pancho Rd., Camarillo, Calif. 93012; Jason A. Mazzota, 903 Central Parkway, Stuart, Fla. 34994

[21] Appl. No.: 677,985

[22] Filed: Jul. 10, 1996

[51] Int. Cl.[6] ..... A45F 3/00

[52] U.S. Cl. ..... 224/677; 224/673; 224/904; 224/676; 224/270; D3/228

[58] Field of Search ..... 224/904, 249, 224/251, 255, 256, 270, 271, 272, 676, 677, 678, 242, 240, 673; D3/228, 229

[56] References Cited

U.S. PATENT DOCUMENTS

| | | | |
|---|---|---|---|
| 2,692,712 | 10/1954 | Conley | 224/249 |
| 4,121,743 | 10/1978 | Burton | 224/271 |
| 4,638,530 | 1/1987 | Perry . | |
| 4,809,894 | 3/1989 | Viio | 224/904 |
| 4,936,499 | 6/1990 | Gulley | 224/904 |
| 5,014,892 | 5/1991 | Copeland | 224/271 |
| 5,052,603 | 10/1991 | Spina | 224/904 |
| 5,248,072 | 9/1993 | Jones . | |
| 5,265,312 | 11/1993 | Okumura . | |
| 5,341,975 | 8/1994 | Marinescu . | |
| 5,375,749 | 12/1994 | Oliva | 224/904 |
| 5,673,830 | 10/1997 | Matthews | 224/904 |

*Primary Examiner*—Henry J. Recla
*Assistant Examiner*—Gregory M. Vidovich
*Attorney, Agent, or Firm*—McHale & Slavin

[57] ABSTRACT

The instant invention is a bracket that secures to pneumatic tools or tools having a detachable handle. The apparatus allows the power tool to be carried by an individual in combination with an engagement holster having provisions for attachment to an individual's belt. The device does not effect operation of the tool or require any modification other than placement either beneath the air chuck or the threaded handle on battery or electric powered tools. The bracket and holster of the instant apparatus each includes a surface area for placement of indicia such as a logo or advertisement.

10 Claims, 2 Drawing Sheets

TOOL SUPPORT

FIELD OF THE INVENTION

The instant invention relates to the field of power tools and in particular to a holster for use in combination with a portable power tool for purposes of supporting the tool against the side of an individual's body.

BACKGROUND OF THE INVENTION

Portable power tools enhance the working potential of an individual if properly utilized. Such tools permit an individual to quickly perform tasks that otherwise are both time consuming and strenuous. For instance, a business that replaces automobile tires typically employs a pneumatic wrench to remove and replace the lug nuts from the automobile wheel. The pneumatic wrench removes the laborious task of turning the wrench and provides an impact torque not possible by an individual using a hand wrench. Similarly, a roofer may utilize a pneumatic stapler, nailer, or like device for attaching shingles to a roof. Such devices have the obvious effect of making a repetitive job simpler. In addition, such tools provide a uniform attachment not possible with ordinary hand tools. Portable power tools include those tools powered by battery and electricity.

A problem with portable tools is their need for support when not in use. An ordinary hand tool may be placed in a pocket allowing accessibility at all times. This is especially important in instances where a tool may not be set down. For instance, any tool used on a sloped roof must be carried at all times to prevent it from sliding down the incline of the roof.

There also remains a concern over theft of tools not kept close by the rightful owner. For these reasons, prior art devices teach the use of tool holders for maintaining the tool on the individual allowing accessibility as well as security. Of particular interest is the support of such tools from a belt, to which this invention pertains. U.S. Pat. No. 4,638,530 sets forth a tool carrier consisting of a bracket that couples to an individual's belt thereby maintaining a tool in a position for ease of access. Numerous revisions to such a concept have also been patented such as U.S. Pat. No. 5,248,072 which discloses a belt suspended tool holder for hammers. U.S. Pat. No. 5,341,975 discloses a clip that secures to the back of a pouch for attachment to a belt wherein the pouch includes numerous pockets for placement of various tools such as hammers, screwdrivers, knives and so forth.

The problem with the prior art is the need for support of portable power tools which are both heavier and, due to their cost, more prone to theft. Such tools may be of a size and weight that prohibits an individual from holding it throughout the day. For instance, the mechanic that replaces automobile tires requires both hands to remove a tire, but placing the tool on the ground could be dangerous as he is no longer supporting the tire during such a movement. Also when the tool is on the ground it may be tripped over and requires retrieval for use with the next tire. Similarly, the roofer may need to set down a pneumatic stapler, nailer, or like device when positioning the next shingle. However, the roofer cannot simply set the tool down without it sliding off the roof, requiring the tool to be moved to a flat area or held by another individual. When pneumatic tools are used, it is not uncommon for a roofer to wrap the hose around his leg or shoulder for support. Either option is time consuming, and possibly dangerous. For this reason, there exists a need for holding of portable power tools to the waist of an individual in a similar manner as the prior art discloses for ordinary hand tools.

In this manner, U.S. Pat. No. 5,265,312 discloses a hook which snaps onto a Makita power tool allowing the tool to be placed along the side of an individual. This device secures to a battery operated drill having a pair of specially placed slots that are receptive to a hook shaped device having a pair of engaging tabs. The hook shaped members limit the application of the device to this particular manufacturer and fails to address the multitude of power tools on the market in need of such support.

Thus, what is lacking in the art is a tool holder for attachment to power tools having a detachable handle and a particular universal attachment to pneumatic tools.

SUMMARY OF THE INVENTION

The instant invention is for use with power tools and in particular for use with tools either having a detachable handle or which are pneumatically powered. In the preferred embodiment, the device consists of a hook shaped tool bracket that is placed beneath the air chuck of a pneumatic power tool. The bracket is L-shaped and allows for support in conjunction with a belt mounted holster worn by an individual. In this manner, a portable power tool that is not in use can be conveniently hung from the waist of the individual.

The support bracket of the instant invention includes a first aperture sized for insertion of a pneumatic air chuck fitting making installation the simple process of removing the air chuck for subsequent placement of the bracket beneath the air chuck. The bracket does not inhibit use of the air chuck operating as an oversized washer. Each edge of the bracket is enlarged to create a bevel shape leading toward a pointed end for placement within a holster having a reciprocal shape. The bracket does not effect operation of the tool nor inhibit operation of the trigger mechanism.

A second aperture on the bracket allows for attachment to power tools having a removable handle. The bracket is placed beneath the handle which is threaded to the power tool providing a second means for bracket attachment without tool modification. A third aperture located along a side of the bracket allows the tool to be supported by a hook or similar hanger device when stored for long periods of time.

The holster used in combination with the bracket is preferably constructed of leather having a depth that provides secure engagement of the bracket yet prohibits seizing of the bracket to the holster. Slots located on the upper portion of the holster allow for use with a waist belt.

Thus, a primary objective of the instant invention is to provide a support bracket and holster that supports power tools from an individual's belt for ease of tool accessibility.

Another objective of the instant invention is to provide a support bracket that can be secured to a power tool having a detachable handle or pneumatically powered tools having an air chuck.

Yet still another objective of the instant invention is to provide an inexpensive power tool support bracket that allows for either left or right handed placement maintaining handle integrity and access to the operating switches.

Yet another objective of the instant invention is to provide a holster that prohibits seizure of the support bracket despite tool weight.

Other objectives and advantages of this invention will become apparent from the following description taken in conjunction with the accompanying drawings wherein are set forth, by way of illustration and example, certain embodiments of this invention. The drawings constitute a part of this specification and include exemplary embodiments of the present invention and illustrate various objectives and features thereof.

DETAILED DESCRIPTION OF THE PREFERRED EMBODIMENT

Although the invention will be described in terms of a specific embodiment, it will be readily apparent to those skilled in this art that various modifications, rearrangements and substitutions can be made without departing from the spirit of the invention. The scope of the invention is defined by the claims appended hereto.

Figure 1:
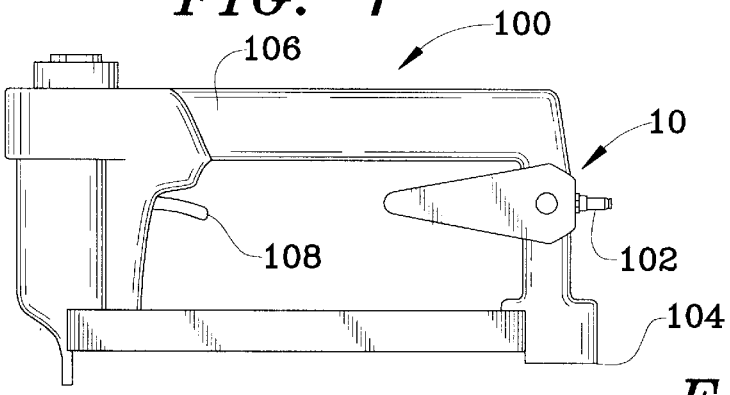
FIG. 1 is a side elevation view of a pneumatic stapler with the tool support bracket of the instant invention installed beneath the air chuck.
Figure 2:
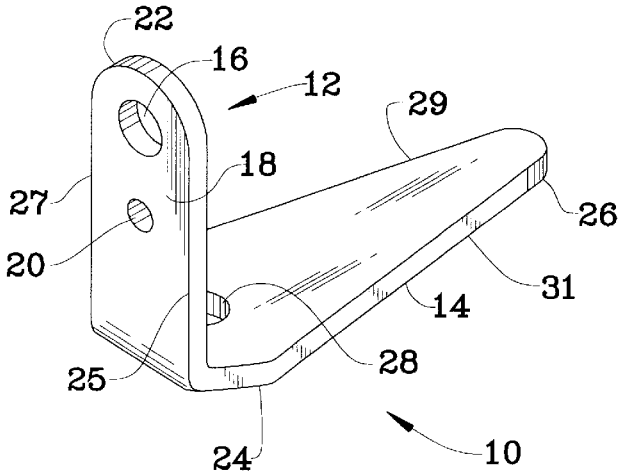
FIG. 2 is a perspective view of the tool support bracket.

Now referring to FIGS. 1 and 2, the apparatus consists of a tool support bracket 10 shown coupled to a pneumatic staple gun 100 by means of air chuck 102 positioned along one end 104 of the staple gun handle 106. The bracket is L-shape having a coupling section 12 and insertion section 14. The coupling section 12 includes a first aperture 16 having a diameter of 9/16ths of an inch to accommodate the partial insertion of an air chuck having a tightening nut greater than the diameter of the aperture. The outer surface 18 of the coupling end 12 serves as a washer upon engagement of the air chuck.

An alternate attachment for power tools having a detachable handle is provided through second aperture 20 having a diameter of 7/16ths of an inch to accommodate the threaded portion of most detachable handles, the outer surface 18 of the coupling end 12 again serving as a washer for engagement of the detachable handle. The coupling portion 12 has a rounded edge 22 leading to equally spaced apart side edges 25 and 27 leading to an insertion end positioned at a right angle wherein side edges 29 and 31 extend outwardly forming an enlarged upper portion 24 creating a triangular shaped wedge leading to a pointed end 26. The support bracket is fabricated from an L-shaped rigid piece of metal demarcating a coupling portion 12 and an insertion portion 14.

The wedge shape allows for partial insertion into a holster as described later in this specification. Aperture 28 is preferably a 3/8 inch hole provided along the face of the insertion portion 14 for use in attachment to a wall hook when in a storage situation. The centering of aperture 16 provides bracket positioning on either side of the tool handle. In this manner a right handed individual may utilize the tool support bracket as illustrated with both the handle 106 and on-off trigger 108 accessible without interference from the support bracket 10. Similarly, if the individual was left-handed the support bracket 10 may be located on the opposite side wherein an individual could also utilize the tool without interference with the handle or trigger. It should be noted that in either position, the bracket does inhibit use but simply allows an individual to choose which side of the body the tool is to be supported from.

Figure 3:
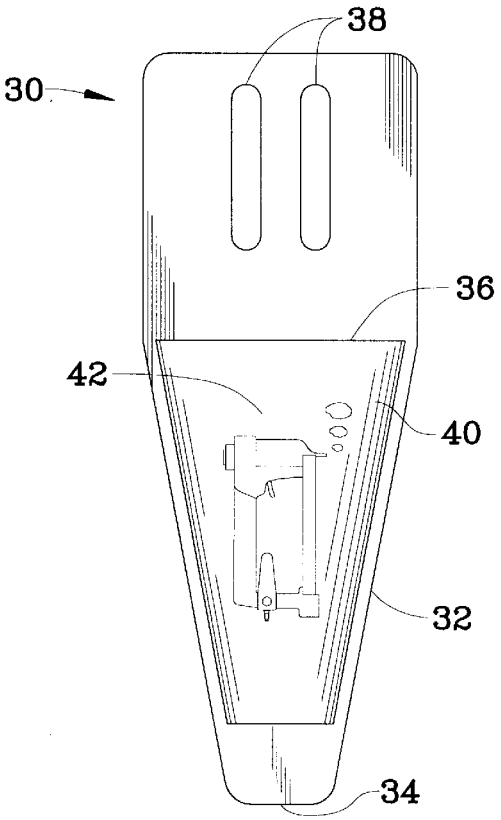
FIG. 3 is a front plane view of the holster for use with the tool support bracket.

Now referring to FIG. 3, set forth is a front view of the holster 30 used in combination with the support bracket. The holster 30 is defined by an upper portion which secures to the belt of an individual, the upper portion including slots 38 for interweaving of a belt worn around the waist of an individual. A lower portion 32 accommodates the triangular point of the insertion end of the support bracket. The insertion end of the support bracket is placed through opening 36 forming a pocket opening. Preferably the holster is constructed of leather while other materials could be substituted without defeating the objective of this invention. Leather construction allows the holster to remain flexible yet prevent excessive swinging of the tool by having a depth of approximately 5 inches. The bottom of the holster may be open to allow for moisture drainage. The front 42 of the holster provides an area for placement of indicia such as the name of the tool manufacturer or advertising logos.

Figure 4:
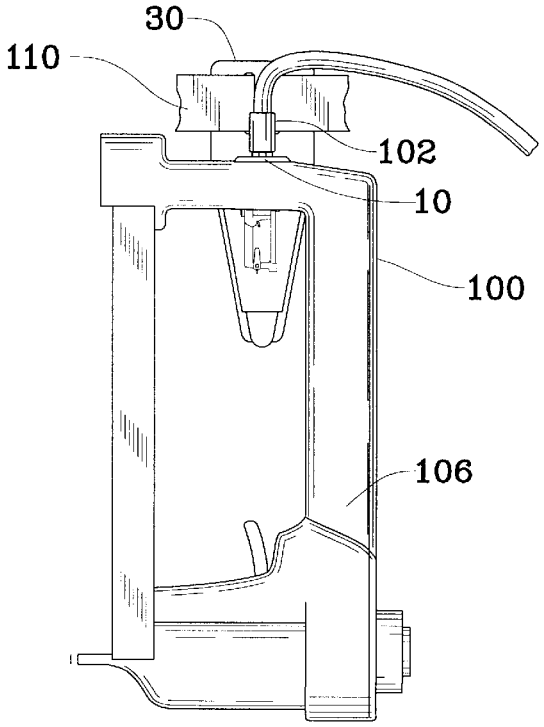
FIG. 4 is a pictorial view of the staple gun with the tool support bracket inserted into the holster.
Figure 5:
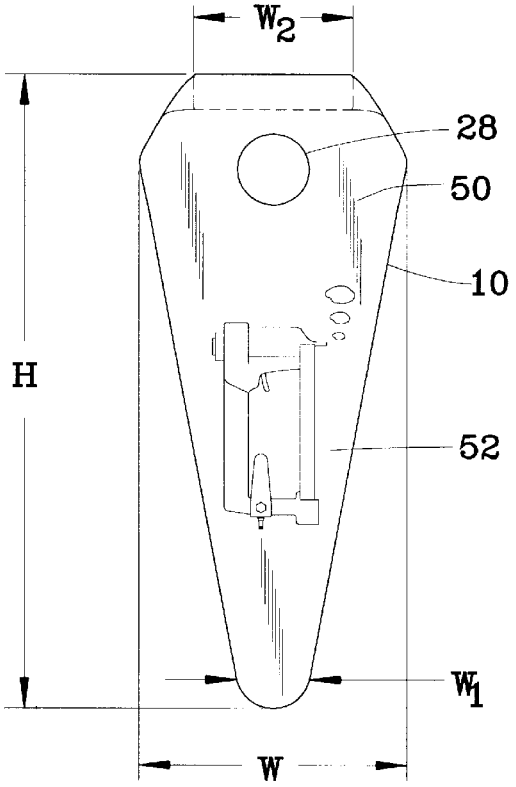
FIG. 5 is a front plane view of the tool support bracket.
Figure 6:
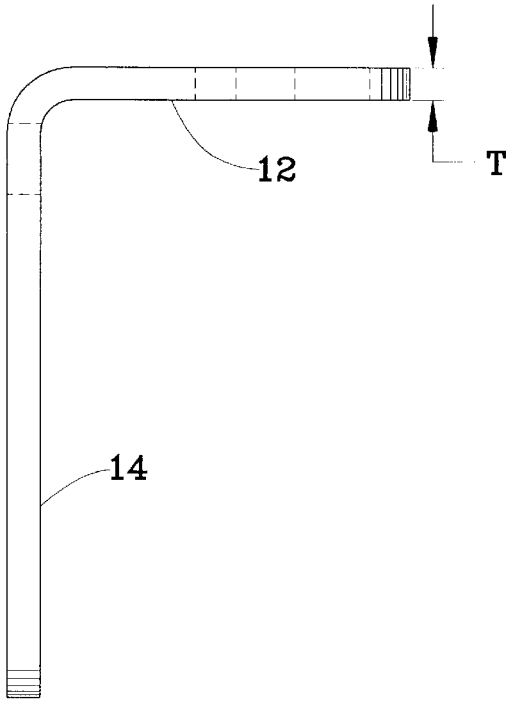
FIG. 6 is a side plane view of the tool support bracket.

Now referring to FIG. 4, set forth is a pictorial view of the tool 100 placed within holster 30 shown coupled to a belt 110. The holster 30 hangs downwardly from the belt for receipt of the support bracket placed beneath the air chuck 102. The weight of the tool maintains the support bracket in position with handle 106 maintained in a position for ease of quick release as needed. FIGS. 5 and 6 set forth a front and side plane view respectively of the tool support bracket 10 having an enlarged frontal surface 50 for placement of indicia 52. The third aperture 28, as previously described, is provided for support of the tool against a wall for storage. Preferably the support bracket has a thickness T of approximately one quarter inch aluminum. The insertion end 14 is wedge shaped having a first width along an upper portion of said insertion end and a second width along a lower portion of said insertion end, said first width greater than said second width, said coupling portion including a first and second aperture. The support bracket has a width W of approximately 1 7/8 of an inch along the upper support portion narrowing to approximately 3/8 of an inch $W_1$ along the insertion end portion 14. The width $W^2$ of the upper portion of the support bracket being approximately 1 1/4 inch.

Figure 7:
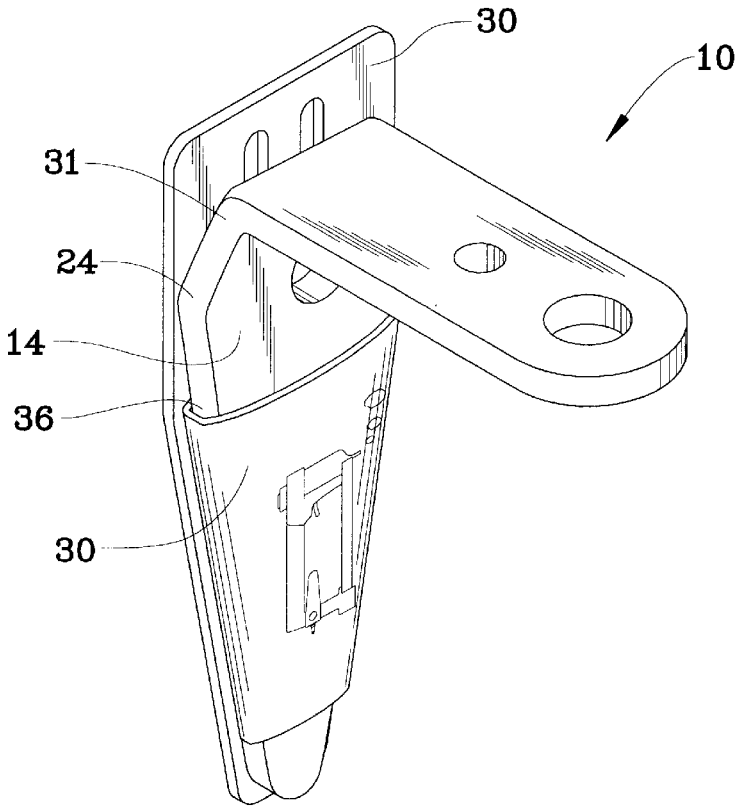
FIG. 7 is a perspective view of the tool support bracket without a power tool as inserted into the holster.

Now referring the FIG. 7 the holster 30 is depicted with the tool support bracket 10 inserted within the holster 30 through opening 36, the support bracket 10 having side edge 31 and opposing side edge, not shown, engaging the lip of the opening. The enlarged upper portion 24 permits insertion of the lower end 14 only to such a position so as to maintain removability thus preventing over insertion.

It is to be understood that while I have illustrated and described certain forms of my invention, it is not to be limited to the specific forms or arrangement of parts herein described and shown. It will be apparent to those skilled in the art that various changes may be made without departing from the scope of the invention and the invention is not to be considered limited to what is shown in the drawings and described in the specification.

We claim:

1. An apparatus for use in suspending a portable power tool from an individual's belt, said apparatus comprising:

a bracket means defined by a coupling portion and an insertion portion, said coupling portion including a first aperture for acceptance of a threaded end of a detachable handle used on portable power tools and a second aperture for acceptance of an air chuck used on portable power tools;

a wedge shaped holster structure receptive to the slidable insertion of said insertion portion of said bracket means; and, a means for securing said holster structure to an individual;

wherein said bracket means is adapted to be coupled to a portable power tool by placement of the threaded portion of an air chuck used on pneumatic tools through said second aperture and said holster structure is secured to the belt of an individual wherein said power tool may be suspended from the waist of an individual when said insertion portion of said bracket means is inserted into said holster structure.

2. The apparatus for use in suspending a portable power tool from an individual's belt according to claim 1 wherein said wedge shaped holster structure is further defined as a backing sheet and an insertion portion, said insertion portion of said backing sheet having a first width along an upper portion and a second width along a lower portion of said insertion portion, said first width greater than said second width, said backing sheet having two elongated slots placed in a spaced apart parallel position and adapted to receive a belt wherein a belt woven through said slots secures said holster structure to the waist of an individual.

3. The apparatus for use in suspending a portable power tool from an individual's belt according to claim 2 wherein said insertion portion of said holster structure includes an area for placement of indicia.

4. The apparatus for use in suspending a portable power tool from an individual's belt according to claim 1 wherein said holster structure is fabricated from leather.

5. The apparatus for use in suspending a portable power tool from an individual's belt according to claim 1 including a third aperture located in said insertion portion, said third aperture having a diameter of approximately ⅜ths inch for use in storing said tool by insertion of a wall mounted hook through said third aperture.

6. An apparatus for use in suspending a portable power tool from an individual's belt, said apparatus comprising:

a bracket means fabricated from an L-shaped rigid piece of metal demarcating a coupling portion and an insertion portion, said insertion portion is wedge shaped having a first width along an upper portion of said insertion portion and a second width along a lower portion of said insertion portion, said first width greater than said second width, said coupling portion including a first aperture and a second aperture;

a holster structure comprising a backing sheet having two elongated slots placed in a spaced apart parallel position and a wedge shaped leather receptacle receptive to the slidable insertion of said insertion portion of said bracket means;

wherein said bracket means is adapted to be coupled to a portable power tool by placement of the threaded portion of an air chuck or detachable handle through said first or second aperture and said holster structure is adapted to be secured to the belt of an individual by weaving a belt through said elongated slots, whereby said power tool may be suspended from the waist of an individual when said insertion portion of said bracket means is inserted into said holster structure.

7. The apparatus for use in suspending a portable power tool from an individual's belt according to claim 6 wherein said first aperture has a diameter of 9/16ths inch for acceptance of a threaded end of an air chuck used on portable pneumatic power tools.

8. The apparatus for use in suspending a portable power tool from an individual's belt according to claim 6 wherein said second aperture has a diameter of 7/16ths inch for acceptance of a threaded end of a detachable handle used on portable power tools.

9. The apparatus for use in suspending a portable power tool from an individual's belt according to claim 6 including a third aperture located in said insertion portion, said third aperture having a diameter of approximately ⅜ths inch for use in storing said tool by insertion of a wall mounted hook through said third aperture.

10. The apparatus for use in suspending a portable power tool from an individual's belt according to claim 6 wherein said first width across said upper portion of said insertion portion is greater than a width across said coupling portion.

* * * * *